US005210978A

United States Patent [19]

Phillips

[11] Patent Number: 5,210,978

[45] Date of Patent: May 18, 1993

[54] NOSE PIECE RETAINER FOR ABRASIVE BELT BACKING SHOE

[75] Inventor: James D. Phillips, Posen, Mich.

[73] Assignee: J. D. Phillips Corporation, Alpena, Mich.

[21] Appl. No.: 888,143

[22] Filed: May 26, 1992

[51] Int. Cl.[5] ..... B24B 21/18

[52] U.S. Cl. ..... 51/141; 51/145 R; 51/148

[58] Field of Search ..... 51/141, 145 R, 148, 51/59 R, 62

[56] References Cited

U.S. PATENT DOCUMENTS

| | | | |
|---|---|---|---|
| 1,660,291 | 6/1925 | Birkigt | 51/227 R |
| 1,813,503 | 10/1927 | Merryweather | 51/105 SP |
| 1,843,301 | 9/1929 | Player et al. | 51/89 |
| 2,098,438 | 5/1932 | Stubbs | 51/105 EC |
| 2,195,054 | 8/1937 | Wallace et al. | 51/105 R |
| 2,553,831 | 1/1949 | Musyl | 51/101 R |
| 2,728,173 | 12/1955 | Banks | 51/141 |
| 2,901,870 | 9/1959 | Zirbel | 51/141 |
| 3,127,712 | 4/1964 | Krogen | 51/148 |
| 3,452,488 | 7/1969 | Palaski | 51/262 |
| 3,760,537 | 9/1973 | Bovati | 51/105 R |
| 4,091,573 | 5/1978 | Schmidt | 51/140 |
| 4,175,358 | 11/1979 | Bischeri | 51/142 |
| 4,204,371 | 5/1980 | Horwitz | 51/141 |
| 4,242,837 | 1/1981 | Lohse | 51/59 R |
| 4,292,767 | 10/1981 | Fatula | 51/145 R |
| 4,382,727 | 5/1983 | Schmidt | 51/140 |
| 4,443,977 | 4/1984 | Gaiani | 51/141 |
| 4,601,134 | 7/1986 | Hessemann | 51/141 |
| 4,607,461 | 8/1986 | Adams | 51/165.8 |
| 4,833,834 | 5/1989 | Patterson | 51/147 |
| 4,945,683 | 8/1990 | Phillips | 51/145 R |

FOREIGN PATENT DOCUMENTS

| | | | |
|---|---|---|---|
| 1944194 | 8/1969 | Fed. Rep. of Germany | 51/141 |
| 473595 | 10/1975 | U.S.S.R. | 51/141 |

OTHER PUBLICATIONS

U.S. patent application Ser. No. 07/593,694, Phillips, filed Oct. 5, 1990.

*Primary Examiner*—Bruce M. Kisliuk
*Assistant Examiner*—Bo Bounkong
*Attorney, Agent, or Firm*—Barnes, Kisselle, Raisch, Choate, Whittemore & Hulbert

[57] ABSTRACT

A retainer for the nose piece of the shoe which backs the abrasive belt in a belt-type grinding machine. The nose piece is T-shaped having a cross member provided with opposite side portions and a stem between the side portions. The head of the shoe has a stem-receiving recess and outwardly facing locating shoulders on opposite sides of the recess. The nose piece is mounted on the head with its stem in the recess and its side portions overlying the shoulders. The retainer is a pin having a resilient shank provided with an offset which may be either a laterally bent portion of the shank or a cam-like projection on the shank. The pin is received in aligned openings in the head and in the stem. When rotated to locking position, the pin offset forces the stem down into the recess and also forces the side portions of the cross member down squarely and solidly upon the shoulders.

7 Claims, 2 Drawing Sheets

NOSE PIECE RETAINER FOR ABRASIVE BELT BACKING SHOE

This invention relates generally to belt-type grinding machines and refers more particularly to a retainer for the nose piece of a belt-backing shoe.

BACKGROUND AND SUMMARY

In a belt-type grinding machine, the shoe which holds the abrasive belt in contact with a part being ground often has a replaceable, hardened nose piece. The nose piece is generally T-shaped having a cross member provided with opposite side portions and a stem between the side portions. The head has a stem-receiving recess and outwardly facing locating shoulders on opposite sides of the recess. The nose piece is mounted on the head with the stem in the recess and the side portions of the cross member overlying the shoulders. In the past, the nose piece has been fastened to the head by conventional screws which clamp it against one side of the head rather than down firmly on the locating shoulders. As a result, the nose piece may tip slightly, resulting in imperfectly ground parts.

In accordance with this invention, releasable retainer means are provided to secure the nose piece on the head comprising a pin received in aligned openings in the head and in the stem. The pin has means for forcing the stem into the recess and forcing the side portions of the cross member down squarely and solidly upon the shoulders.

More specifically, the pin has a flexibly resilient shank extending through the openings, and the shank is provided with a lateral offset in the stem opening. The pin is rotatable to a locking position in which the offset presses inwardly on the stem opening to force the side portions of the cross member firmly into bearing engagement with the shoulders. In one embodiment of the invention, the shank has a laterally bent portion providing the offset. In another embodiment, the shank has a projection on one side providing the offset.

One object of the invention is to provide a nose piece retainer having the foregoing features. Further objects are to provide a nose piece retainer which is of relatively simple construction, rugged and durable in use, and easy to manufacture and assemble.

Other objects, features and advantages will become more apparent as the following description proceeds, especially when considered with the accompanying drawings.

DETAILED DESCRIPTION

Figure 1:
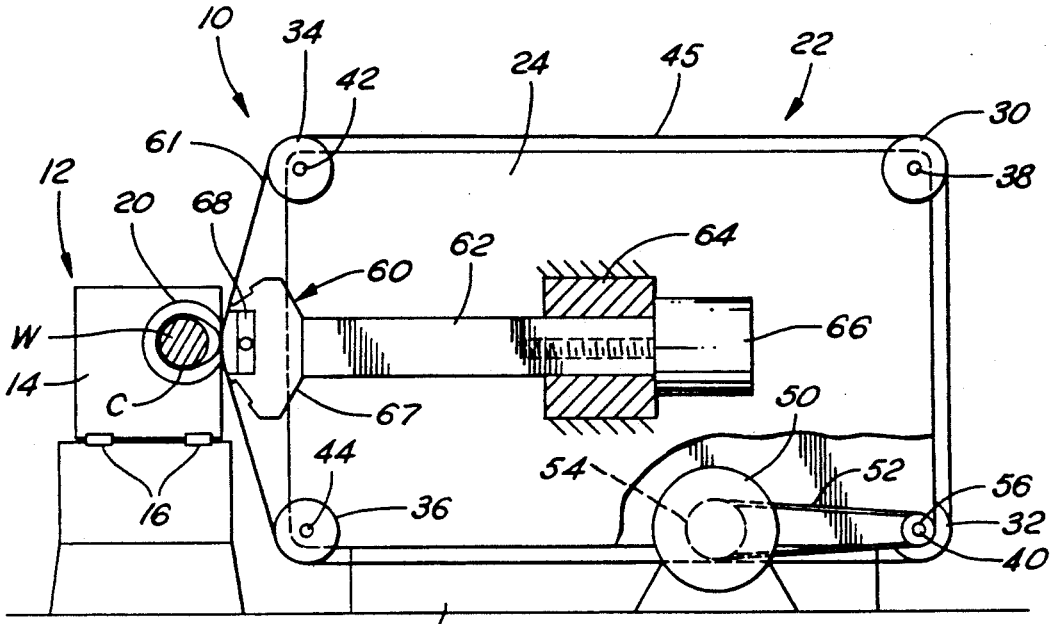
FIG. 1 is a semi-diagrammatic side elevational view of a grinding machine embodying the invention.
Figure 2:
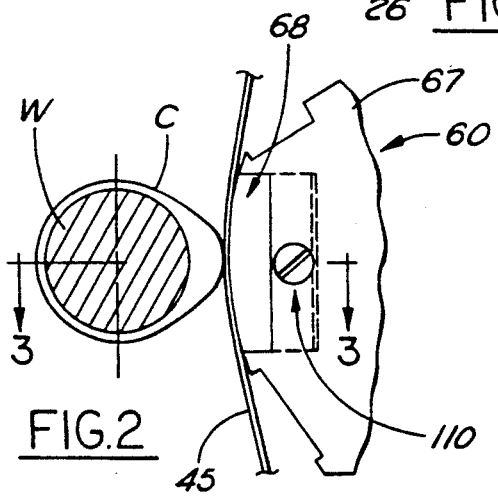
FIG. 2 is an enlarged fragmentary side elevational view showing the nose piece mounted on the head of the belt-backing shoe.
Figure 3:
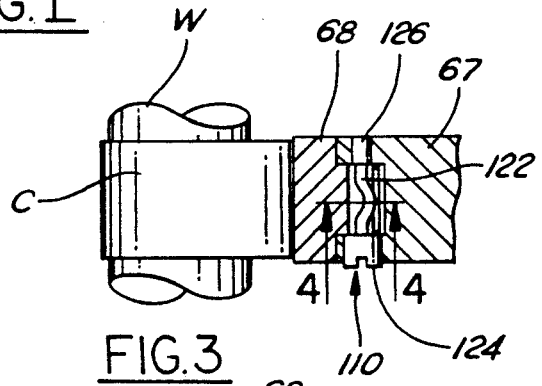
FIG. 3 is a sectional view taken on the line 3—3 in FIG. 2, showing the pin for releasably retaining the nose piece on the shoe in locking position.
Figure 4:
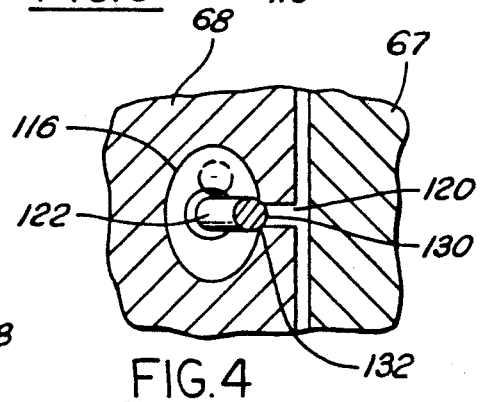
FIG. 4 is a sectional view taken on the line 4—4 in FIG. 3.
Figure 5:
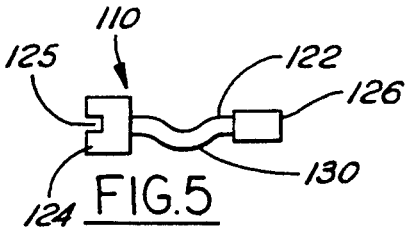
FIG. 5 is a side elevational view of the locking pin.
Figure 6:
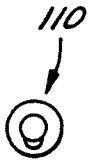
FIG. 6 is an end view of the locking pin.

Referring now more particularly to the drawings and especially to FIGS. 1–6, the grinding machine 10 has a work holding unit 12 comprising a table 14 slidably mounted on waybars 16 and movable to an adjusted position by any suitable means (not shown). The table has a head stock 20 and tail stock (not shown) for supporting an elongated workpiece W such as a cam shaft parallel to the direction of table movement. The cam shaft has a plurality of cams C along its length, one of which is shown in FIG. 1. The cam shaft is rotated by any suitable power source, such, for example, as a motor in the head stock.

A grinding unit 22 is provided to grind the periphery of the cam C as the cam shaft rotates. It will be understood that additional grinding units may be provided so that several cams may be ground at the same time.

The grinding unit 22 has an upright frame 24 mounted on a base 26. The frame 24 has two vertically spaced rear belt pulleys 30 and 32 and two vertically spaced front belt pulleys 34 and 36. These pulleys 30, 32, 34 and 36 are rotatable on shafts 38, 40, 42 and 44 carried by the frame. A flexible endless abrasive belt 45 has an abrasive surface on one side and a backing surface on the opposite side and extends over the pulleys. The belt extends in a plane perpendicular to the cam shaft.

A motor 50 provides the power for driving the abrasive belt. A timing belt 52 extends over a pulley 54 on the output shaft of the motor and over a timing belt pulley 56 affixed to the abrasive belt pulley 32. Operation of the motor will move the abrasive belt linearly and it will be understood that the front generally vertically extending portion 61 of the abrasive belt will make grinding contact with the cam as the cam shaft rotates in order to grind the cam to a predetermined contour.

A shoe 60 is provided for each grinding unit to guide the generally vertical portion 61 of the abrasive belt at the point where it contacts the cam. This shoe is carried on the front end of an elongated actuator 62. The rear end of the actuator is mounted for reciprocation in a housing 64 mounted on frame 24 and is reciprocated by a motor and ball screw drive 66. The shoe has a head 67 provided with a diamond or ceramaic nose piece 68 which bears against the back side of the abrasive belt. The shoe will be described in the position it assumes in this particular grinding machine, that is, in which the head 67 extends forwardly and the nose piece is or the front of the head. It will be understood, however, that the shoe may just as well be disposed in any other position depending on the particular construction of the grinding machine.

The head 67 of the shoe is in the form of a flat blade or plate which in this embodiment is disposed vertically so as to extend in the plane of the abrasive belt which it backs. A notch 70 is cut across the front of the head from one vertical side wall 72 to the other vertical wall 74. The notch has a flat front surface 76 and parallel horizontal top and bottom surfaces 78 and 80 at right angles to the front surface. A recess or socket 82 in the front surface 76 divides the front surface into two laterally spaced flat, co-planar vertical shoulders 84 and 86. The recess is preferably rectangular having vertically spaced parallel end walls extending in continuation of the surfaces 78 and 80 of the notch 70 and laterally spaced side walls parallel to the side walls 72 and 74 of the head.

The nose piece 68 is of integral, generally T-shaped construction, having a cross member 96 and a stem 98. The length of the cross member is the same as or only slightly less than the space between the end walls 78 and 80 of the notch and its width is preferably the same as the width of the head measured between the side walls 72 and 74.

The stem 98 extends from the rear side of the cross member. It preferably is the same length as the cross member but narrower in width so that the cross member has two side portions 100 and 102. The rear surfaces 104 and 106 of the side portions are flat and co-planar. The stem is preferably of the same rectangular configuration as the recess, except slightly smaller, so that it will fit snuggly in the recess.

When the nose piece is assembled with the head with its stem extending into the recess, the rear surfaces 104 and 106 of the side portions of the cross member have a flush engagement with the shoulders 84 and 86 of the head. The surfaces 104, 106 and shoulders 84, 86 are precision ground so that when in flush engagement the nose piece is properly oriented causing the belt to grind the cam exactly to the required dimensions.

A retainer 110 is provided to mount the nose piece 68 on the head 67 and more specifically to force the stem 98 of the nose piece down into the recess 82 and to force the side portions 100 and 102 of the cross member squarely and solidly against the shoulders so that the undersurfaces 104, 106 of the side portions 100 and 102 of the cross member are in flush engagement with the shoulders 84, 86.

The retainer 110 is in the form of a pin which is disposed in aligned openings in the head and in the stem of the nose piece. These aligned openings include the spaced holes 112 and 114 formed in the head on opposite sides of the recess 82, and a hole 116 in the stem. When the nose piece 68 is properly assembled on the head with the stem 68 in the recess and the side portions 100, 102 of the cross member overlying the shoulders 84, 86, the holes 112, 114 and 116 line up. The hole 112 is relatively large and circular. The hole 114 is smaller and also circular. The hole 116 in the stem is oval-shaped, with its major diameter parallel to the lengthwise dimension of the cross member and its minor diameter at right angles to the major diameter. The holes 112, 114 and 116 have a common axis. There is a split at 120 in the stem, extending from the rear end of the stem into the hole 116 along the minor axis thereof.

The retainer pin 110 has an elongated flexibly resilient shank 122, an enlarged circular head 124 at one end of the shank, and a circular collar 126, which is smaller in diameter than the head 124, at the opposite end of the shank. The head 124 is only slightly smaller in diameter than hole 112, and has a slot 125 so that the pin may be turned by a screwdriver or the like. The collar 126 is cylindrical and only slightly smaller in diameter than the hole 114. When the pin is fully inserted in the aligned holes as shown, the head 124 is disposed in hole 112 and the collar in hole 114.

The shank is laterally bent intermediate its ends as shown. The bend in the shank provides a shallow, somewhat U-shaped offset 130 which is located in the stem hole 116 when the pin is fully inserted. The offset, upon insertion of the pin upwardly in FIG. 3, will clear the hole 112, and will also freely enter the hole 116 in the stem provided that the pin is turned so that the offset is on the major diameter thereof (see dotted line position in FIG. 4). The portions of the shank on opposite sides of the offset are co-axial. However, the offset, which is less than one-half the major diameter of hole 116, is greater than one-half the minor diameter thereof so that when the pin is rotated 90° the shank 122 must flex and the offset may even flatten somewhat (see solid line position in FIG. 4). In this latter position (the locking position), the offset snaps into the detent 132 provided by the split 120 to releasably retain the pin against rotation. Also in this position, the pin offset presses the nose piece 68 squarely and solidly down against the shoulders 84 and 86 in flush engagement therewith.

Figure 7:
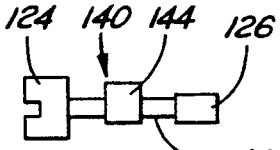
FIG. 7 is a side elevational view of a locking pin of modified construction.
Figure 8:
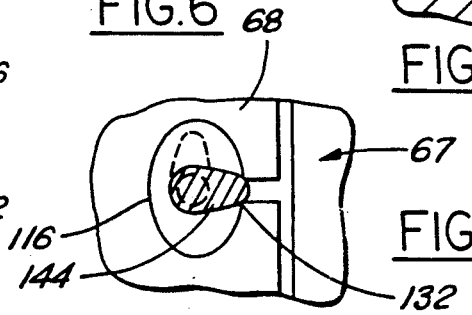
FIG. 8 is a view similar to FIG. 4, but showing the nose piece releasably retained on the shoe by the modified locking pin.
Figure 10:
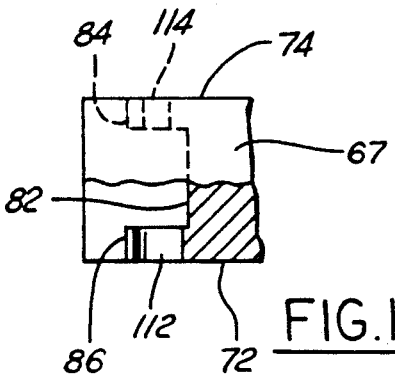
FIG. 10 is a fragmentary end view of the head.

FIG. 7 and 8 show a modified locking pin 140 in which the shank 142, instead of being bent, has a cam 144 between its ends providing the offset. The offset of cam 144 is similar to that of the bend 130 in pin 110, that is, it is less than one-half the major diameter of hole 116 but greater than one-half the minor diameter thereof. When the pin is turned so that the cam 144 is aligned with the major axis of the hole 116, and when inserted as described in connection with pin 110, it easily clears the wall of the hole 116. When turned 90°, the cam binds on the wall of hole 116, flexing the shank and releasably locking in the detent with the same results as with pin 110.

Figure 12:
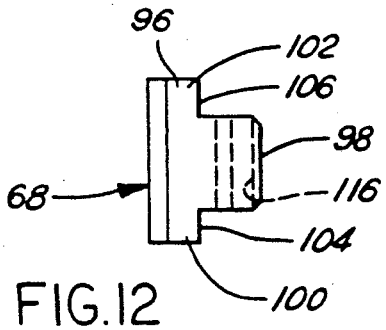
FIG. 12 is an end view of the nose piece.
Figure 9:
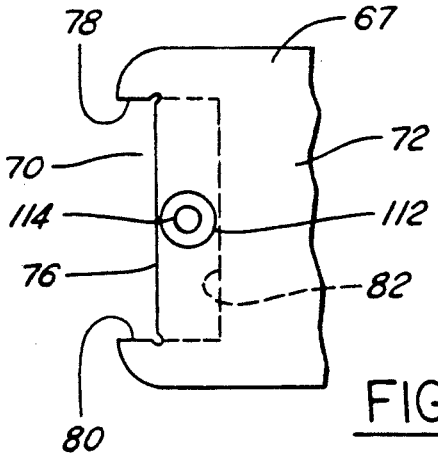
FIG. 9 is a fragmentary side elevational view of the head.
Figure 11:
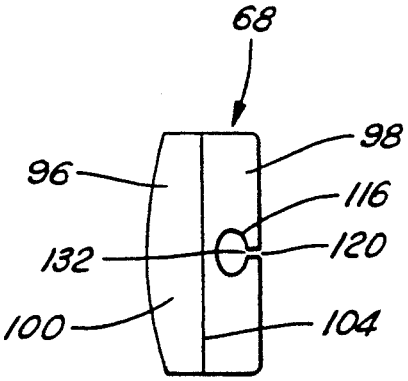
FIG. 11 is a side elevational view of the nose piece.
Figure 13:
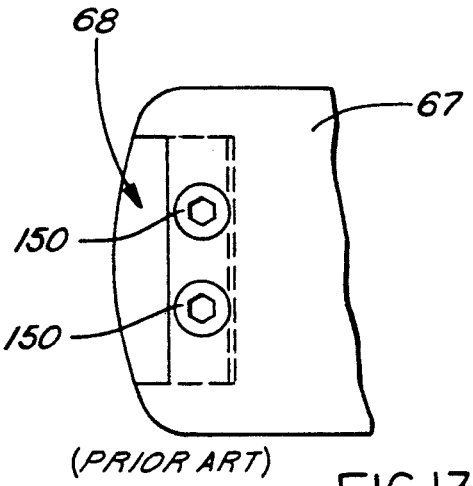
(PRIOR ART) FIG.13
FIG. 13 is a fragmentary side elevational view in which the nose piece is shown being held on the head by a prior art retainer.
Figure 14:
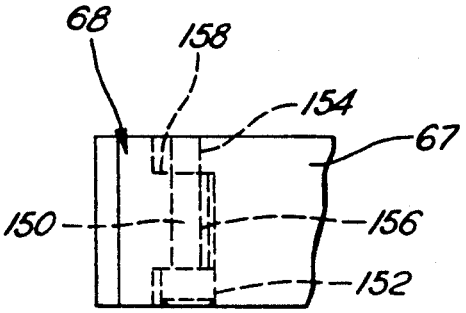
(PRIOR ART) FIG.14
FIG. 14 is a fragmentary end view of the structure shown in FIG. 13.

FIGS. 12 and 13 are illustrative of the prior art in which two standard screws 150 extend through two sets of three aligned holes 152, 154 and 156 in the head and in the stem of the nose piece. The holes 154 are tapped and the screws thread into the tapped holes. However, the nose piece is clamped against one side 158 of the nose piece rather than down on the shoulders as in accordance with this invention. In other words, in the prior art the clamping pressure is in the direction of the length of the screws, not downward on the shoulders 84 and 86. In the present construction, on the other hand, the clamping pressure is perpendicular to the locking pin and perpendicular to the plane of the shoulders 84 and 86 which support the nose piece so that the clamping pressure is downward on the shoulders.

While this invention has been shown in connection with the grinding of cams on a camshaft, it will be understood that it has broader application and may also be used in the grinding of other workpieces, such, for example, as the crank pins of a crankshaft.

What is claimed is:

1. In apparatus for grinding a part such as a cam which includes a linearly-driven elongated abrasive belt having a part-contacting abrasive surface on one side and a backing surface on the opposite side, and a shoe for holding said belt in grinding contact with said part, the improvement wherein said shoe has a head provided with a separable nose piece engageable with the backing surface of the belt, said nose piece being generally T-shaped having a cross member provided with opposite side portions and a stem between said opposite side portions projecting laterally from said cross member, said head having a surface facing said backing surface of the abrasive belt formed with a stem-receiving recess and locating shoulders also facing said abrasive belt on opposite sides of said recess, said nose piece being mounted on said head in operative position with said stem disposed in said recess and said opposite side portions of said cross member overlying said respective shoulders, and releasable means for securing said nose piece in said operative position comprising a pin, said head having spaced openings and said stem having an opening between and aligned with said spaced openings, said pin having a flexibly resilient shank extending through said head and stem openings, said shank having an offset in said stem opening, said pin being rotatable to a locking position in which said offset presses inwardly on said stem opening to force said side portions of said cross member firmly into bearing engagement with said shoulders, and means for releasably retaining said pin in said locking position.

2. Apparatus as defined in claim 1, wherein said shank has a laterally bent portion providing said offset.

3. Apparatus as defined in claim 2, wherein said means for releasably retaining said pin in said locking position comprises a detent in said stem opening engageable with said offset in said locking position.

4. Apparatus as defined in claim 1, wherein said shank has a projection on one side thereof providing said offset.

5. Apparatus as defined in claim 4, wherein said means for releasably retaining said pin in said locking position comprises a detent in said stem opening engageable with said offset in said locking position.

6. Apparatus as defined in claim 1, wherein said shank is aligned with the center of said stem opening, said stem opening is shaped to permit free entry of said shank when turned to a position of entry turned 90° from said locking position, said means for releasably retaining said pin in said locking position comprises a detent in said stem opening engageable with said offset when said shank is rotated from said position of entry to said locking position.

7. Apparatus as defined in claim 6, wherein said stem is split from said opening therein to the inner extremity of said stem forming a recess which provides said detent.

* * * * *